United States Patent [19]

Kasatkin et al.

[11] 4,049,926

[45] Sept. 20, 1977

[54] RIBBON LOUDSPEAKER ACHIEVES FOCUSING AND UNIFORMITY OF THE MAGNETIC FLUX IN THE WORKING GAP

[76] Inventors: Alexei Fedoseevich Kasatkin, ulitsa Pravdy, 7/9, kv. 42; Jury Vasilievich Smirnov, ulitsa Alabyana, 11, kv. 44; Ilya Afanasievich Feldman, ulitsa Dubininskaya, 6, korpus 1, kv. 269, all of Moscow, U.S.S.R.

[21] Appl. No.: 646,546

[22] Filed: Jan. 5, 1976

[30] Foreign Application Priority Data

Jan. 14, 1975 U.S.S.R. ..... 2090006

[51] Int. Cl.[2] ..... H04R 9/02

[52] U.S. Cl. ..... 179/115 V

[58] Field of Search ..... 179/115 V

[56] References Cited

U.S. PATENT DOCUMENTS

| | | | |
|---|---|---|---|
| 2,476,396 | 7/1949 | Anderson | 179/115 V |
| 2,673,251 | 3/1954 | Duncan | 179/115 V |
| 3,383,476 | 5/1968 | Morgan | 179/115 V |

*Primary Examiner*—George G. Stellar

*Attorney, Agent, or Firm*—Lackenbach, Lilling & Siegel

[57] ABSTRACT

A ribbon loudspeaker, according to the invention, comprises permanent magnets spaced from each other along an axis and making up a magnetic system, and sound-reproducing ribbons freely vibrating, independent of each other placed in a working gap between the poles of permanent magnets. The side surfaces of the permanent magnets are made convex and spaced from the axis, whereas their pole surfaces are made concave and spaced along the axis. The permanent magnets are magnetized by way of separate magnetization of their central parts in the plane of a sound-reproducing ribbon and portions adjoining their side surfaces. The proposed ribbon loudspeaker ensures higher fidelity of sound.

6 Claims, 1 Drawing Figure

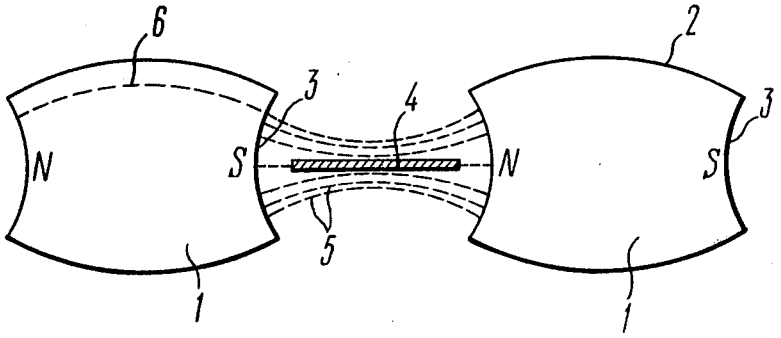
6
2
3
4
3
N
S
N
S
5
1
1

RIBBON LOUDSPEAKER ACHIEVES FOCUSING AND UNIFORMITY OF THE MAGNETIC FLUX IN THE WORKING GAP

This invention relates to electroacoustic devices and, in particular, to ribbon loudspeakers.

The invention may be used in domestic radio equipment, film projection equipment, acoustic equipment of concert halls and in all other instances requiring high-fidelity sound reproduction.

The knwon ribbon loudspeaker magnetic systems comprise permanent magnets, the working gap between their poles containing a sound reproducing ribbon and the magnetic flux in the working gap being concentrated by means of various pole shoes which are made of non-retentive material.

In designing ribbon loudspeakers it is a common practice to make the sound-reproducing ribbon as wide as possible, because it expands frequency characteristics of a ribbon loudspeaker in the low audio frequency area and raises its efficiency. However, non-uniformity of magnetic density in the gap increases as the gap is widened and the average value of magnetic density is reduced. The use of pole shoes made of non-retentive material in large gaps cannot provide the required concentration and uniformity of the magnetic flux in the plane of the sound-reproducing ribbon.

It is an object of this invention to increase the efficiency of focusing and uniformity of magnetic density in the working gap of a ribbon loudspeaker.

This object is achieved by providing a ribbon loudspeaker comprising permanent magnets spaced from each other along an axis and making up a magnetic system and freely vibrating, independently of each other sound-reproducing ribbons, each of said ribbons being placed in a working gap between the poles of respective permanent magnets, the surfaces of poles of two adjacent permanent magnets spaced along the axis are, according to the invention, made concave and the side surfaces of the permanent magnets spaced from the axis are made convex.

The object is also achieved by utilizing a method of magnetization of permanent magnets which, according to the invention, consists in separate magnetization of the central parts of permanent magnets in the plane of sound-reproducing ribbons and the parts of permanent magnets adjacent to their side surfaces, the density of the magnetization field being increased from the central part of the permanent magnets towards their side surfaces.

The invention will now be described in greater detail with reference to a specific embodiment thereof, taken in conjunction with the accompanying drawing.

A ribbon loudspeaker comprises permanent magnets 1 Figure generally spaced from each other along a predetermined direction or axis, their side surfaces spaced from the axis, being designated as 2 and pole surfaces spaced along the axis as 3. In the embodiment shown, the axis is generally an axis of symmetry and the side surfaces 2 are gneerally parallel to the axis, while the pole surfaces 3 are generally orthogonal to the axis. A sound reproducing ribbon 4 is situated in a working gap between the opposite poles N and S of the permanent magnets 1. A magnetic field of the permanent magnets 1, is represented by magnetic lines of force 5. One of the enveloping surfaces of the permanent magnets 1 is designated as 6.

When the ribbon loudspeaker is switched on, the audio frequency current passing through sound reproducing ribbons 4 (FIGURE) sets up a magnetic field therearound and said field interacts with the field of the permanent magnets 1 and causes mechanical vibrations of the sound-reproducing ribbon 4 which radiates sound.

Side surfaces 2 of the permanent magnets 1 are made convex, whereas pole surfaces 3 are made concave. This causes the magnetic lines 5 of force to be brought closer together in the area of the sound-reproducing ribbon 4 making the magnetic field in this area more uniform and concurrently increasing magnetic density. The side and pole surfaces 2 and 3 may be made so that in this projection they are concave and convex lines respectively. The curvature of the side and pole surfaces 2 and 3 of the permanent magnets 1 defines the degree of magnetic field focusing in the working gap. The focusing effect is illustrated in the figure as the magnetic lines of force 5 in the area of the sound-reproducing ribbon 4.

To enhance the focusing effect the central parts of the permanent magnets 1 near the axis plane and the parts of the permanent magnets 1 adjacent to the side surfaces 2 are magnetized separately. Owing to separate magnetization of the permanent magnets 1 the magnetomotive force in the plane of the sound-reproducing ribbon 4, that is along the magnet axis N-S, is less than along any of the enveloping surfaces 6, the magnetomotive force being increased with the growth of the distance from the axis plane and reaching its maximum value on the side surface 2.

The magnetization field density is selected so that it is less, when the central part is magnetized, and increases, when the parts adjacent to the side surfaces 2 are magnetized.

Employment of the permanent magnets 1 of the proposed shape in a ribbon loudspeaker ensures an increase of inductance in the area of the sound-reproducing ribbon 4 of no less than 70%.

What is claimed is:

1. A ribbon loudspeaker comprising at least two permanent magnets together making up a magnetic system, said magnets being spaced from each other generally along an axis, each permanent magnet having a pair of generally convex opposing side surfaces spaced from said axis, and having a pair of generally concave opposing pole surfaces spaced from each other along said axis, the facing concave pole surfaces of two adjacent permanent magnets together defining a working gap; and a freely vibrating sound reproducing ribbon positioned in said working gap.

2. A ribbon loudspeaker as defined in claim 1, wherein said axis comprises an axis of symmetry.

3. A ribbon loudspeaker as defined in claim 1, wherein a plurality of similarly-shaped permanent magnets are provided and spaced from each other along said axis, each pair of facing concave pole surfaces of two adjacent permanent magnets together defining a working gap, and a freely vibrating sound reproducing ribbon positioned in each working gap.

4. A ribbon loudspeaker as defined in claim 1, wherein said convex side surfaces are disposed on opposite sides of said axis.

5. A ribbon loudspeaker as defined in claim 1, wherein said convex side surfaces are generally parallel to said axis, and said concave pole surfaces are generally orthogonal to said axis.

6. A ribbon loudspeaker as defined in claim 1, wherein said ribbon is disposed generally along said axis.

* * * * *